US005949192A

United States Patent [19]

Kominami et al.

[11] Patent Number: 5,949,192

[45] Date of Patent: Sep. 7, 1999

[54] OPERATING APPARATUS FOR DISCHARGE LAMP

[75] Inventors: Satoshi Kominami, Katano; Kouji Miyazaki, Yawata; Shigeru Horii, Takatsuki, all of Japan

[73] Assignee: Matsushita Electric Industrial Co., Ltd., Osaka, Japan

[21] Appl. No.: 08/912,232

[22] Filed: Aug. 15, 1997

[30] Foreign Application Priority Data

Aug. 21, 1996 [JP] Japan ..... 8-219584

[51] Int. Cl.[6] ..... H05B 39/00

[52] U.S. Cl. ..... 315/94; 315/106; 315/112; 315/595

[58] Field of Search ..... 315/94, 97, 56, 315/106, 107, 112, 291, 209 R, 289, DIG. 7; 313/595, 616, 291, 11

[56] References Cited

U.S. PATENT DOCUMENTS

| | | | |
|---|---|---|---|
| 4,742,275 | 5/1988 | Ito et al. | 315/104 |
| 4,939,417 | 7/1990 | Biblarz et al. | 313/595 |
| 4,992,703 | 2/1991 | Ramaiah | 315/261 |
| 5,051,665 | 9/1991 | Garrison et al. | 315/287 |
| 5,583,396 | 12/1996 | Hideaki et al. | 315/106 |

FOREIGN PATENT DOCUMENTS

| | | |
|---|---|---|
| 0 399 288 | 11/1990 | European Pat. Off. . |
| 51-66174 | 6/1976 | Japan . |
| 58-115751 | 7/1983 | Japan . |
| 6-111762 | 4/1994 | Japan . |
| 7-146515 | 6/1995 | Japan . |
| 8-130096 | 5/1996 | Japan . |

OTHER PUBLICATIONS

Byszewski, W.W. et al.: HID Starting: Glow Discharge and Transition to the Thermionic ARC—Journal of the Illuminating Enginerring Society, vol. 20, No. 2, Jan. 1, 1991, pp. 3–9, XP000227292 * p. 3, right–hand column, line 13—p. 3, right hand column, line 29.

Pabst, W. et al.: Igniting High–Pressure Lamps With Electronic Ballasts—Journal of the Illuminating Engineering Society, vol. 21, No. 2, Jan. 1, 1992, pp. 14–20, XP000296444.

*Primary Examiner*—Don Wong
*Assistant Examiner*—Haissa Philogene
*Attorney, Agent, or Firm*—Snell & Wilmer

[57] ABSTRACT

An operating apparatus for a discharge lamp, which includes a pair of electrodes and an arc tube having a material enclosed therein, includes: a selective depositing device for selectively depositing the material on one electrode of the pair of electrodes when the discharge lamp is turned off; and a ballast circuit for starting operation of the discharge lamp and maintaining the operation under rated conditions. The ballast circuit includes a starting pulse generator for applying a starting pulse to the discharge lamp when the discharge lamp starts the operation. The starting pulse generates an electric field acting from the one electrode of the pair of electrodes having the material deposited thereon to the other electrode.

19 Claims, 7 Drawing Sheets

OPERATING APPARATUS FOR DISCHARGE LAMP

BACKGROUND OF THE INVENTION

1. Field of the Invention

The present invention relates to an operating apparatus (in other words, a lightening apparatus) for a discharge lamp, and in particular to an operating apparatus for reducing a starting voltage of the discharge lamp by intentionally depositing a material enclosed in the discharge lamp on one of two electrodes in the discharge lamp.

2. Description of the Invention

HID lamps have been more and more widely used recently for their features of, for example, high luminance, high efficiency and long life. In particular, metal halide lamps have been used as a light source for indoor lighting, light sources for video equipment, and headlights of automobiles, in view of their satisfactory color rendering characteristics.

A discharge lamp requires a ballast circuit for generating a starting pulse for starting discharge and supplying power for maintaining the operating state.

Generally, a voltage required for starting operation (i.e., discharge) of the lamp (hereinafter, referred to as the "starting voltage") is significantly higher than the voltage required when the lamp is operating under the rated conditions, and typically needs to be as high as several kilovolts to several tens of kilo-volts. Accordingly, a ballast circuit includes a starting pulse generator for generating such a high level of starting pulse when the operation is to be started. However, the starting pulse generator requires sufficient insulation since it generates such a high level of voltage. Accordingly, the starting pulse generator occupies a large area, despite operating only when discharge is started. The starting voltage needs to be lowered in order to reduce the size of the starting pulse generator.

A method for lowering such a high starting voltage is disclosed in, for example, Japanese Laid-Open Publication No. 51-66174. According to the method disclosed in this publication, a radioactive material is enclosed in the discharge lamp, and ionization of the gas in the discharge lamp is facilitated by the radioactive rays generated by the radioactive material, thereby reducing the starting voltage.

Japanese Patent Application No. 6-265318 (corresponding to Japanese Laid-Open Publication No. 8-130096) and Japanese Laid-Open Publication No. 7-146515 each disclose a method for reducing the starting voltage by preventing the material enclosed in the discharge lamp (hereinafter, referred to as an "enclosed material") from depositing on the electrodes.

In general, the starting voltage is lower when no enclosed material is deposited on the electrodes than when some of the enclosed material is deposited on the electrodes. This is considered to be resulted because the work function changes at the tip of the electrode by the enclosed material depositing thereon.

A metal material mainly containing tungsten has a smaller heat capacity than that of quartz glass forming the arc tube. Thus, when the discharge lamp is turned off, the temperature of the electrodes is lowered more rapidly than that of the arc tube. The enclosed material in the discharge lamp, which is in an evaporated state while the lamp is operated, can condense and stay stably on a surface where the temperature is sufficiently lowered. Since the temperature of the electrodes is first lowered, the enclosed material deposits on the electrodes.

Accordingly, the next time when the discharge lamp is operated, discharge is started in the state where the enclosed material deposits on the electrodes. As a result, the starting voltage is raised. The enclosed material depositing on the electrodes can be easily confirmed by visual inspection.

Japanese Patent Application No. 6-265318 (corresponding to Japanese Laid-Open Publication No. 8-130096) and Japanese Laid-Open Publication No. 7-146515 (supra) each disclose a method for reducing the starting voltage by preventing the enclosed material in the discharge lamp from depositing on the electrodes. According to the method disclosed in Japanese Patent Application No. 6-265318 (corresponding to Japanese Laid-Open Publication No. 8-130096), the discharge lamp is turned off while the current in the lamp is gradually decreased over time, thereby causing the temperature decrease rate of the electrode to slow. Thus, the enclosed material is prevented from depositing on the electrodes, and the starting voltage is maintained low. According to the method disclosed in Japanese Laid-Open Publication No. 7-146515, additional discharge is performed for a short period when a prescribed period of time passes after the lamp is turned off, thereby scattering the particles of the enclosed material from the electrodes. Thus, the starting voltage is maintained low.

The method disclosed in Japanese Laid-Open Publication No. 51-66174 is not desirable in consideration of the effect of the radioactive material enclosed in the discharge lamp on human bodies and environment.

The methods disclosed in Japanese Patent Application No. 6-265318 (corresponding to Japanese Laid-Open Publication No. 8-130096) and Japanese Laid-Open Publication No. 7-146515 require complicated control of the power source (lighting circuit) when the discharge lamp is turned off, and thus stable control cannot be ensured.

SUMMARY OF THE INVENTION

According to the present invention, an operating apparatus for a discharge lamp is provided. The discharge lamp includes a pair of electrodes and an arc tube having a material enclosed therein. The operating apparatus includes: a selective depositing device for selectively depositing the material on one electrode of the pair of electrodes when the discharge lamp is turned off; and a ballast circuit for starting operation of the discharge lamp and maintaining the operation under rated conditions. The ballast circuit includes a starting pulse generator for applying a starting pulse to the discharge lamp when the discharge lamp starts the operation, the starting pulse generating an electric field acting from the one electrode of the pair of electrodes having the material deposited thereon to the other electrode.

In one embodiment, the discharge lamp includes the selective depositing device.

In one embodiment, when the discharge lamp is turned off, the temperature of the electrode on which the material is to be selectively deposited decreases more rapidly than the temperature of the other electrode.

In one embodiment, the discharge lamp further includes a temperature retaining film provided in the vicinity of one electrode of the pair of electrodes.

In one embodiment, each electrode of the pair of electrodes has a different heat capacity from the other.

For example, each electrode of the pair of electrodes may have a different shape from the other. Alternatively, each electrode of the pair of electrodes may have a different volume from the other. As a further alternative, each electrode of the pair of electrodes may have a different surface area from the other. An even further alternative is that each electrode of the pair of electrodes may be formed of a material having a different specific heat from the other.

In one embodiment, the selective depositing device is provided in the discharge lamp.

In one embodiment, when the discharge lamp is turned off, the selective depositing device decreases the temperature of the electrode on which the material is selectively deposited more rapidly than the temperature of the other electrode.

For example, the selective depositing device may be a temperature retaining member. Alternatively, the selective depositing device may be a heating device. As a further alternative, the selective depositing device may be a cooling device. An even further alternative is that the selective depositing device may be a heat radiation device.

The ballast circuit may apply a current including at least a DC component to the discharge lamp while the discharge lamp is operating and thus make the temperature of one electrode of the pair of electrodes higher than the temperature of the other electrode so as to selectively deposit the material on the electrode having the lower temperature when the discharge lamp is turned off.

The ballast circuit may include a vibration application device for applying mechanical vibration to the electrode on which the material is not to be deposited, during a prescribed period of time in which the discharge lamp is off.

The pair of electrodes may be arranged along a direction in which gravity acts, and the electrode on which the material is to be deposited may be positioned lower than the other electrode.

The enclosed material may include at least a metal halide.

Thus, the invention described herein makes possible the advantage of providing a compact operating apparatus for a discharge lamp, which maintains the starting voltage of the discharge lamp at a sufficiently low level by appropriately and selectively controlling the deposition of the enclosed material in the discharge lamp on the electrodes and thus keeps the stable operating state of the discharge lamp at a sufficiently low voltage.

This and other advantages of the present invention will become apparent to those skilled in the art upon reading and understanding the following detailed description with reference to the accompanying figures.

DESCRIPTION OF THE PREFERRED EMBODIMENTS

The reason why an operating apparatus for a discharge lamp according to the present invention reduces the starting voltage of the discharge lamp will be described based on the experiment performed by the present inventors.

Table 1 shows the levels of starting voltage under different depositing states of particles of the enclosed material and different polarities of the applied starting pulse, both measured in the experiment.

Figure 6A:
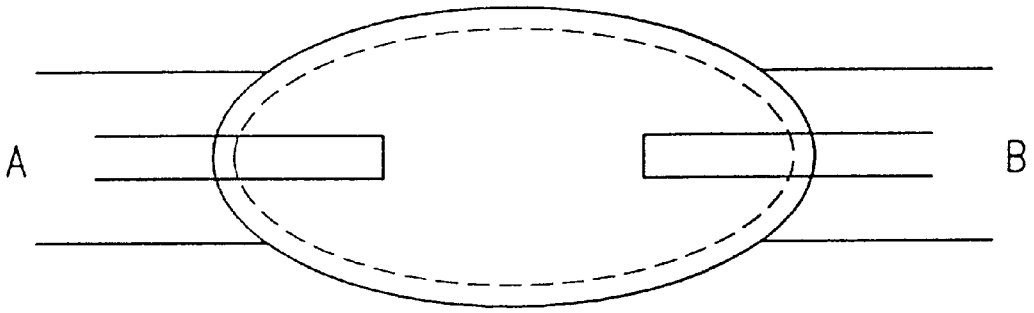
FIGS. 6A, 6B and 6C are cross sectional views of a discharge lamp in which particles of a material enclosed in the discharge lamp are deposited on electrodes in different states.
Figure 6B:
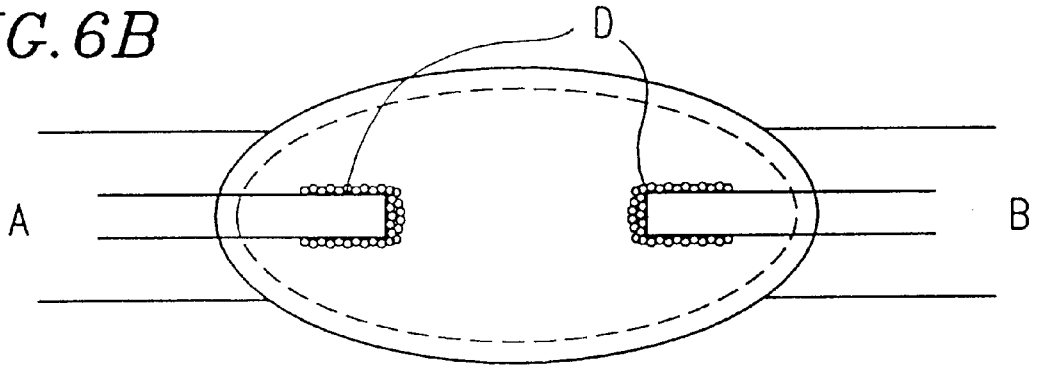
Figure 6C:
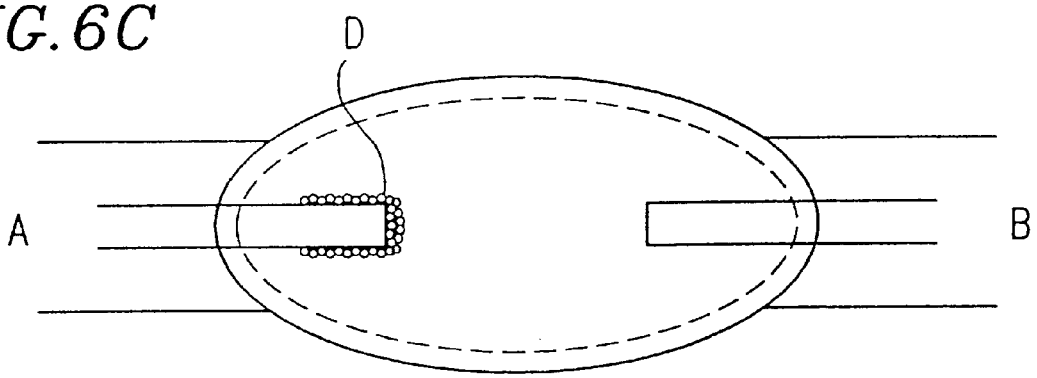

FIGS. 6A, 6B and 6C show different states of the discharge lamp, in which the results shown in Table 1 were obtained. In FIG. 6A, substantially no particles D deposits on either electrode A or B. In FIG. 6B, the particles D deposit on both the electrodes A and B in an equal amount. In FIG. 6C, the particles D deposit only on one of the electrodes A or B (electrode A in the case of FIG. 6C). As the discharge lamp, a 200 W metal halide lamp was used as a sample. In each of the above-described three states, one of two electrodes A or B was grounded, and the other electrode was supplied with a negative starting pulse having a waveform shown in FIG. 7.

TABLE 1

| Depositing state of the enclosed material | Electrode to which the negative starting pulse is applied | |
|---|---|---|
| | Electrode A | Electrode B |
| Material not deposited on electrode A or B | 4.5 | 4.4 |
| Material deposited on both electrodes A And B | 16.6 | 15.7 |
| Material deposited on only electrode A | 16.5 | 5.5 |

Unit:kV

The following was found from the results in Table 1.

In the state of FIG. 6B where the particles D deposit on both the electrodes A and B in an equal amount, a starting voltage of about 15 to 16 V is required to whichever electrode is supplied with a starting pulse. Such a level is significantly higher than the about 4.5 V required in the state of FIG. 6A where substantially no particles D deposit on either electrode.

In the case of FIG. 6C, where the particles D deposit on only one of the electrodes A or B, the required starting voltage is significantly different in accordance with which electrode is supplied with a starting pulse. The required starting voltage is lower when the starting pulse is applied to the electrode with no particles D (electrode B in the case of Table 1). In such a state, the required starting voltage is substantially equal to the starting voltage required when no particles D deposit on either electrode. When the starting pulse is applied to the electrode having the particles D deposited thereon (electrode A in the case of Table 1), the required starting voltage is substantially equal to the starting voltage required when the particles D deposit on both of the electrodes A and B.

In general, the starting voltage of the discharge lamp is governed by (1) α action, in which the gas in the arc tube is ionized by electrons accelerated in the electric field, and (2) γ action, in which positive ions generated by the a action are accelerated in the electric field to collide against an electrode, thereby forcing out the secondary electrons from the electrode. Accordingly, in the state where the particles D deposit on both of the electrodes A and B, the secondary emission by the γ action is difficult to occur because of the deposited particles, which makes discharge difficult. As a result, the starting voltage is raised to an excessively high level. In the case where the particles D deposit on both of the electrodes A and B in an equal amount, the required starting voltage is not significantly different irrespective of which electrode being supplied with a starting pulse.

Figure 7:
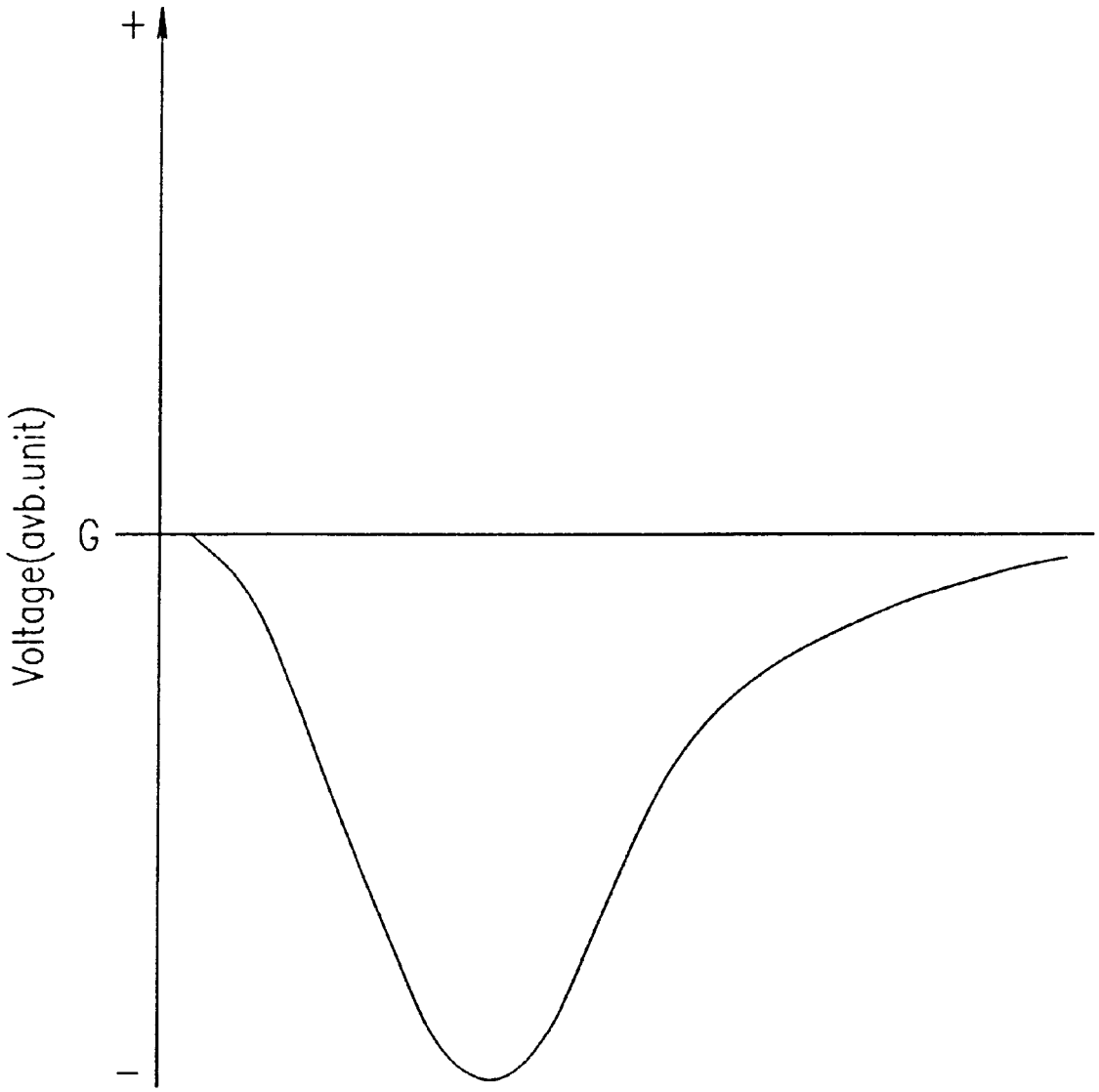
FIG. 7 shows a waveform of a starting pulse to be applied to the discharge lamp according to the present invention.

In the case where the particles D deposit on one of the electrodes, when a negative starting pulse as shown in FIG. 7 is applied to the electrode A having the particles D deposited thereon, an electric field acting from the electrode B toward the electrode A is generated because the potential of the electrode B becomes lower than the potential of the electrode A. Accordingly, the positive ions generated by the a action are accelerated toward the electrode A having the particles D deposited thereon. As a result, the γ action occurs at the electrode A having the particles D. Since the emission of secondary electrons is difficult to occur in this case as described above, a high starting voltage is required.

When a negative starting pulse as shown in FIG. 7 is applied to the electrode B having no particles D deposited thereon, an electric field acting from the electrode A toward the electrode B is generated because the potential of the electrode A becomes lower than the potential of the electrode B. Accordingly, the positive ions generated by the a action are accelerated toward the electrode B having no particles D deposited thereon. As a result, the γ action occurs at the electrode B having no particles D. Since the emission of secondary electrons is easy to occur in this case, the required starting voltage is relatively low.

From the above-described experiment results and studies based on the results, the present inventors have found that the discharge lamp can be operated by a low starting voltage by utilizing the structure in which the particles (mainly derived from the enclosed material in an arc tube of the discharge lamp) are intentionally deposited on only one of the two electrodes, and a starting pulse is selectively applied to one of the electrodes so as to generate an electric field from the electrode having the particles to the electrode with no particles, so that the γ action is generated at the electrode with no particles deposited thereon. The present invention has been made based on the knowledge newly found by the present inventors.

Hereinafter, the present invention will be described by way of illustrative examples with reference to the accompanying drawings.

EXAMPLE 1

Figure 1:
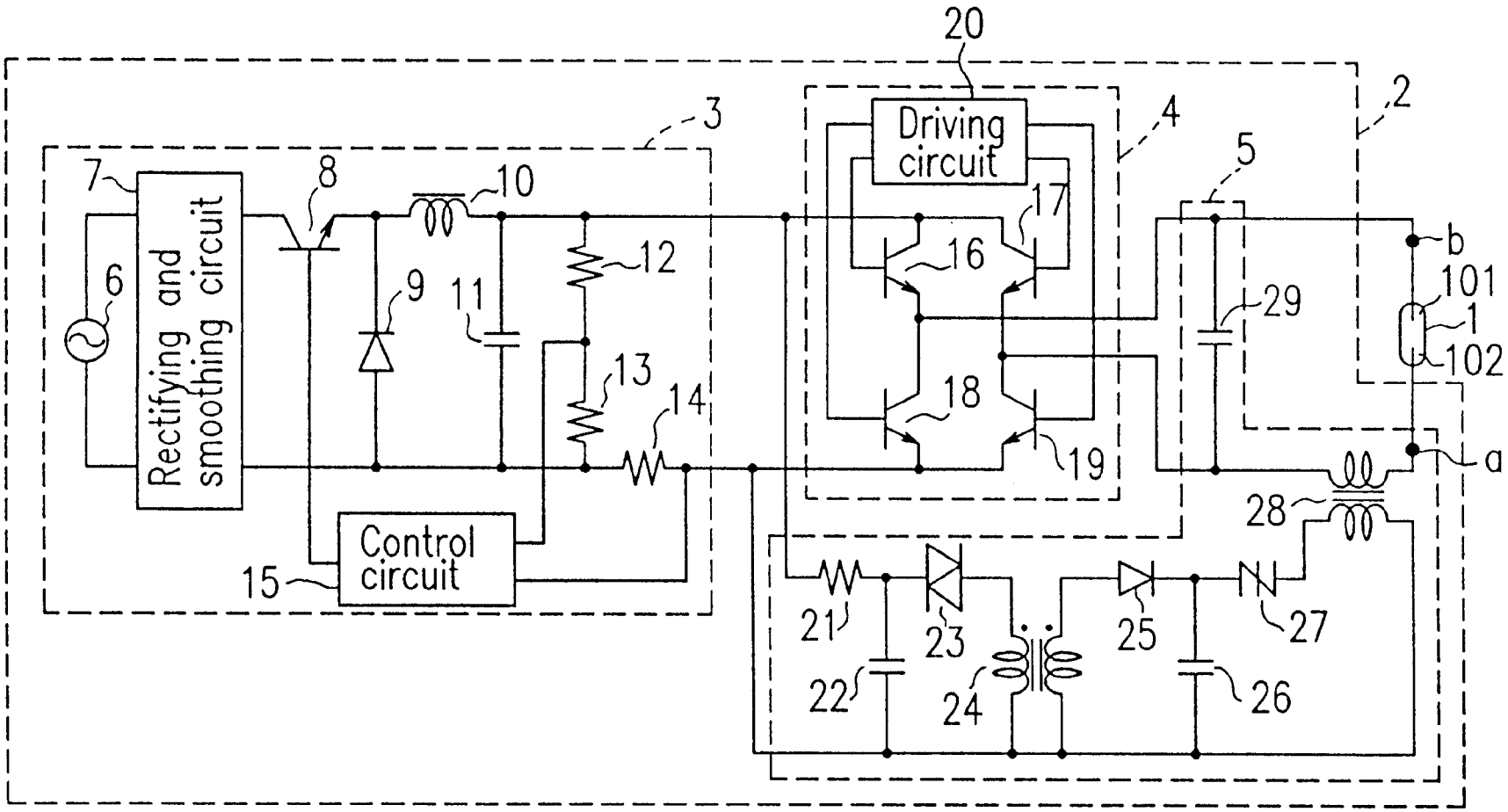
FIG. 1 is a schematic configuration of a ballast circuit in an operating apparatus for a discharge lamp in a first example according to the present invention.

FIG. 1 is a schematic view of the structure of an operating apparatus for a discharge lamp in a first example according to the present invention.

To a discharge lamp 1 (e.g., a 200 W metal halide lamp) having a pair of electrodes 101 and 102, a ballast circuit 2 for starting and maintaining the operating condition of the discharge lamp 1 is connected. The ballast circuit 2 includes a DC power supply 3, an inverter circuit 4, and a starting pulse generator 5.

The DC power supply 3 includes a rectifying and smoothing circuit 7 for rectifying and smoothing an output from an AC power supply 6 for commercial use to convert the output into a DC output, and a control section. The control section, which includes a transistor 8, a diode 9, a choke coil 10, a capacitor 11, resistors 12, 13 and 14, and a control circuit 15, receives the output from the rectifying and smoothing circuit 7 and controlling the power to be supplied to the lamp 1 to be at a prescribed value. The resistors 12 and 13 detect the output voltage from the DC power supply 3 (lamp voltage), and the resistor 14 detects the output current from the DC power supply 3 (lamp current). The two detection signals obtained by the resistors 12, 13 and 14 are processed by the control circuit 15, and the transistor 8 is controlled to be turned on or off by an output signal from the control circuit 15 so that the output voltage from the DC power supply 3 (lamp voltage) has a prescribed value.

The inverter circuit 4 includes transistors 16, 17, 18 and 19, and a driving circuit 20. The transistors 16 and 19 and transistors 17 and 18 are turned on alternately by an output signal from the driving circuit 20. In this manner, the output from the DC power supply 3 is converted into an AC signal and output.

The starting pulse generator 5 includes a resistor 21, a capacitor 22, a bidirectional two-terminal thyristor 23 which becomes conductive when the voltage of the capacitor 22 reaches a prescribed value, a transformer 24, a diode 25, a capacitor 26, a discharge gap 27 which becomes conductive when the voltage of the capacitor 26 reaches a prescribed value, a pulse transformer 28, and a capacitor 29. Thus, the starting pulse generator 5 generates a starting pulse for starting the operation of the lamp 1.

Figure 2A:
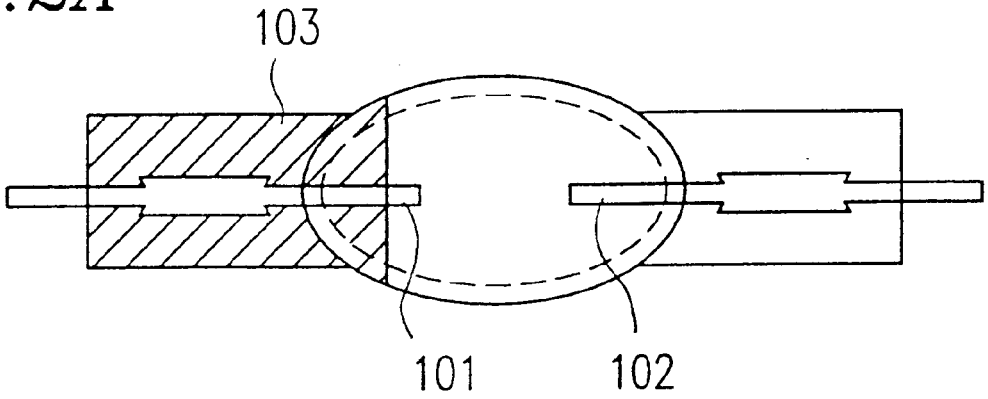
FIG. 2A is a schematic cross sectional view of the discharge lamp to be used with the operating apparatus shown in FIG. 1.
Figure 2B:
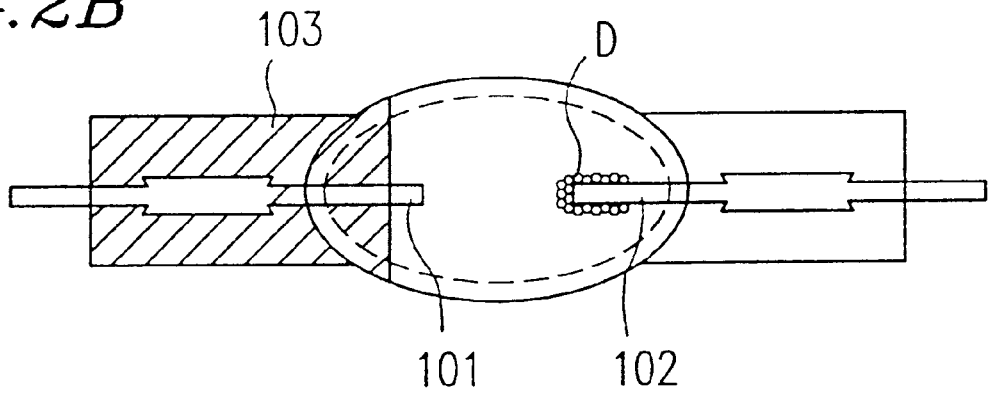
FIG. 2B is a cross sectional view of the discharge lamp shown in FIG. 2A, in which particles of a material enclosed in the discharge lamp are deposited on one of two electrodes.
Figure 2C:
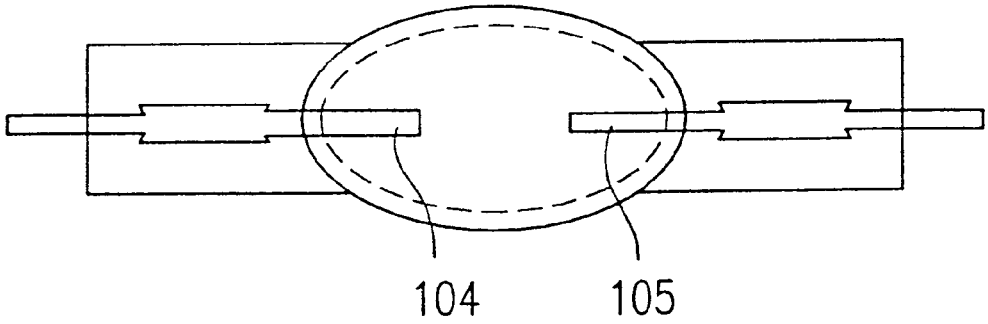
FIG. 2C is a cross sectional view of a discharge lamp in a modification of the discharge lamp shown in FIG. 2A.

With reference to FIGS. 2A, 2B and 2C, the structure of the 200 W metal halide lamp 1 will be described.

FIG. 2A is a schematic cross sectional showing the structure of the lamp 1. The lamp 1 includes the pair of electrodes 101 and 102. A part of the surface in the vicinity of one of the electrodes (the electrode 101 in FIG. 2A) is coated with a temperature retaining film 103. The temperature of the one electrode 101 is prevented from rapidly decreasing by the temperature retaining film 103, and thus makes a difference in temperature between the electrodes 101 and 102 when the lamp 1 is turned off. Thus, the particles of the enclosed material in the lamp 1 are intentionally deposited on the electrode 102 which is not covered with the temperature retaining film 103, and thus is lowered in temperature more rapidly than the electrode 101.

The electrodes 101 and 102 are typically formed of tungsten (melting point: 3,400° C.; boiling point: 5,700° C.; specific heat at the temperature of 0° C. 0.133 J/g.K). Tungsten is selected as a material which withstands a temperature of as high as about 3,000° C., which is a typical temperature of the electrodes while the lamp 1 is on. Alternatively, a mixture or compound of tungsten and at least one different material can be used. For example, thorium tungsten (ThW) containing tungsten and thorium (Th) can be used for the electrodes.

In the arc tube of the lamp 1, mercury (melting point: −39° C.; boiling point: 357° C.) and/or a metal halide is enclosed in addition to noble gas. Usable metal halides include, for example, sodium iodide (melting point: 662° C.; boiling point: 1,304° C.), thallium iodide (melting point: 442° C.; boiling point: 823° C.), indium iodide (melting point: 359° C.; boiling point: 726° C.), or scandium iodide (melting point: 953° C.; sublimation point: 912° C.). Any of these materials is evaporated and exists in the arc tube in a gaseous state when the lamp 1 is on. When a temperature condition is achieved in which the enclosed material can exist sufficient stably in consideration of the melting point and boiling point (or sublimation point) in accordance with the decrease in temperature when the lamp 1 is turned off, the enclosed material deposits on the surface of the electrodes, the inner surface of the arc tube, and the like. In this specification, the enclosed material in the state of depositing on the above-mentioned parts of the lamp 1 will be also referred to as, for example, the "depositing particles" or similar expressions.

Hereinafter, the operation of the operating apparatus according to the present invention will be described.

When the lamp 1 is operated under the rated conditions and then turned off, the lamp 1 is put into the following state.

When the lamp 1 is turned off, the temperature of the lamp 1 starts decreasing. At this point, the heat capacity of the electrodes 101 and 102 formed of a metal material mainly containing tungsten is smaller than the heat capacity of the arc tube mainly formed of quartz glass. Accordingly, the temperature of the electrodes 101 and 102 decreases more rapidly than the temperature of the arc tube.

In accordance with the decrease in the temperature, particles of the enclosed material in the arc tube, which were in a gaseous state when the lamp 1 was on, tends to deposit on any place inside the lamp 1. The temperature of the electrode 101 is more difficult to decrease than the temperature of the electrode 102 by the function of the temperature retaining film 103. Accordingly, the particles hardly deposit on the electrode 101 covered with the temperature retaining film 103, and instead deposit on the electrode 102 (particles D in FIG. 2B).

When the lamp 1 is operated in the state where the particles D is deposited on the electrode 102, the following occurs.

The lamp 1 starts operation by the application of the starting pulse supplied from the starting pulse generator 5. In detail, the starting pulse generator 5 operates in the following manner. The capacitor 22 is charged at a prescribed time constant. When the capacitor 22 is charged to have a prescribed voltage, the bidirectional two-terminal thyristor 23 becomes conductive. Thus, the voltage of the transformer 24 is raised, thereby charging the capacitor 26 via the diode 25.

When the capacitor 26 is charged to have a prescribed voltage, the discharge gap 27 becomes conductive. Thus, the pulse transformer 28 generates a starting pulse. The starting pulse is applied to the lamp 1 via the capacitor 29.

Figure 3:
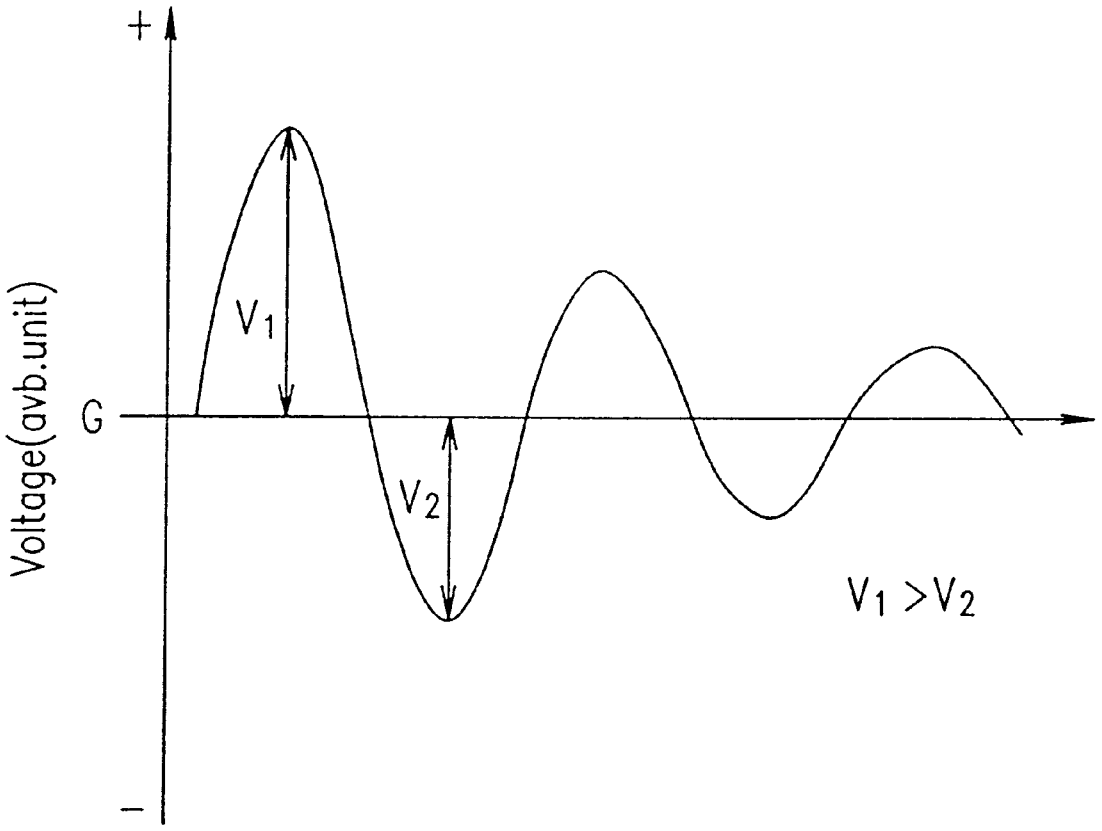
FIG. 3 shows a waveform of a voltage to be applied to the discharge lamp according to the present invention.

At this point, among nodes a and b connected to the lamp 1 in the circuit configuration shown in FIG. 1, the waveform of the voltage at the node a, i.e., the waveform of the starting pulse, as shown in FIG. 3, oscillates between positive and negative values. In accordance with such a periodic oscillation, the direction of the electric field generated between the electrodes 101 and 102 repeats inverting periodically.

When the electric field is generated in the direction from the electrode with the particles (the electrode 102 in FIG. 2B) to the electrode with no particles (the electrode 101 in FIG. 2B), the starting voltage of the lamp 1 is sufficiently low to perform easy start.

Accordingly, when the starting pulse to be applied is negative, the electric field is generated in the direction from the electrode 101 to the electrode 102. Thus, the lamp 1 is not started. When the starting pulse to be applied is positive, the electric field is generated in the direction from the electrode 102 to the electrode 101. Thus, the lamp 1 is started.

After the lamp 1 is operated, the voltage of the capacitor 22 does not reach the voltage required to make the bidirectional two-terminal thyristor 23 conductive. Thus, the starting pulse generator 5 stops the generation of the starting pulse.

Once the lamp 1 starts operating, a signal in proportion to the lamp voltage detected by the resistors 12 and 13 of the DC power supply 3 and a signal in proportion to the lamp current detected by the resistor 14 are processed by the control circuit 15, and the transistor 8 is controlled to be turned on or off so that the power supplied to the lamp 1 has a prescribed value.

The output from the DC power supply 3 is supplied to the lamp 1 after being converted into an AC signal by the inverter circuit 4. The lamp 1 is maintained to be operated by the AC power supplied from the inverter circuit 4.

In the first example, the temperature retaining film 103 is provided in the vicinity of the electrode 101 in order to intentionally deposit the particles of the enclosed material on only one of the two electrodes 101 or 102 of the 200 W metal halide lamp 1. By the function of the temperature retaining film 103, the rate at which the temperature of the electrode 101 decreases when the lamp 1 is turned off is reduced, and thus the particles of the enclosed material can be deposited on only the electrode 102. In the state where the particles are deposited non-uniformly among the two electrodes 101 and 102, a starting pulse for generating an electric field in the direction from the electrode 102 with the particles to the electrode 101 with no particles is generated by the starting pulse generator 5 and is applied to the lamp 1. Thus, the 200 W metal halide lamp 1 can be operated at a relatively low starting voltage by a simple structure without the temperature retaining film in the state where the $\gamma$ action is generated at the electrode having no particles deposited thereon.

In order to realize the above-described selective deposition, an appropriate temperature difference is provided between the two electrodes, in consideration of the thermal characteristics (melting point and boiling point) of the enclosed material (mercury and/or various metal halides). In more detail, one of the electrodes is provided with a temperature at which the enclosed material can exist in a thermally stable state, and the other electrode is provided with a temperature at which the enclosed material cannot exist in such a thermally stable state.

The heat capacities of the electrodes 101 and 102 can be made different from each other by providing the electrodes 101 and 102 with different shapes (volume and/or surface area), instead of by using the temperature retaining film 103. In FIG. 2C, an electrode 104 is larger than an electrode 105. In such a case, the temperature of the electrode 105 decreases more rapidly than the temperature of the electrode 104, and thus the particles of the enclosed material are deposited only on the electrode 105.

Alternatively, each electrode of the pair of electrodes can be formed of different material to make a difference in the temperature decrease rates.

EXAMPLE 2

Figure 4:
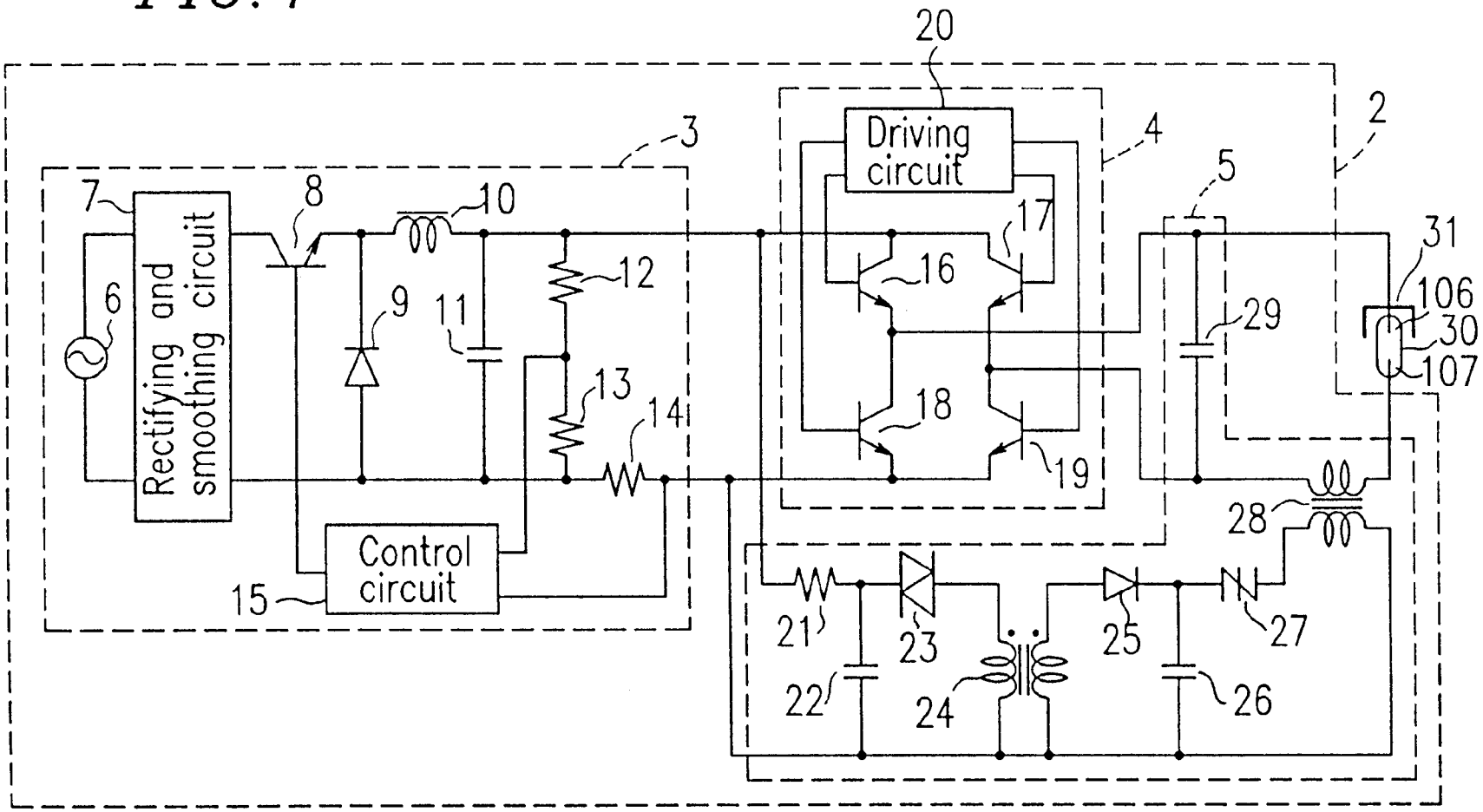
FIG. 4 is a schematic configuration of a ballast circuit in an operating apparatus for a discharge lamp in a second example according to the present invention.

FIG. 4 is a schematic view of the structure of an operating apparatus for a discharge lamp in a second example according to the present invention.

To a discharge lamp 30 (e.g., a 200 W metal halide lamp) having a pair of electrodes 106 and 107, a ballast circuit 2 for starting and maintaining the operating condition of the discharge lamp 30 is connected. Identical elements as those in FIG. 1 bear identical reference numerals and descriptions thereof will be omitted.

In the second example, a temperature retaining member 31 is provided in the vicinity of the electrode 106 in order to intentionally deposit the particles of the enclosed material on only one of the electrodes 106 or 107, instead of the temperature retaining film 103 used in the first example. Since the temperature retaining member 31 can more efficiently prevent the temperature from decreasing than the temperature retaining film 103, the difference in the temperature decrease rates of the electrodes 106 and 107 is further increased. Thus, the particles of the enclosed material is more easily deposited on the electrode 107. Accordingly, the difference in the amount of the particles of the enclosed material deposited on the electrodes 106 and 107 is further increased, which further reduces the starting voltage of the discharge lamp 30.

As in the first example, it is preferable to generate an electric field in the direction from the electrode 107 with the particles to the electrode 106 with no particles when the lamp 30 is turned on. For this purpose, the starting pulse is also preferably applied in the manner described in the first example.

Instead of the temperature retaining member, a heating device for heating only one of the electrodes (e.g., the electrode 106) can be used. The heating device can be, for example, a heater. Light or infrared irradiation can also be employed. Alternatively, a reflective mirror can be provided around one of the electrodes to irradiate the electrode by reflecting the light emitted by the lamp, thereby increasing the temperature of the electrode or preventing the decrease thereof.

Instead of the heating device, a cooling device for cooling only one of the electrodes can be used. The cooling device can be, for example, a cooling member utilizing the Peltier effect, an air cooling device such as a fan, or a liquid cooling device. Alternatively, a part of the electrode can be exposed outside the arc tube for achieving an air cooling effect, or a heat radiation device such as a heat radiation fin can be used.

It should be noted that, in the case where one of the electrodes is provided with the above-mentioned cooling (or heat radiation) device, the temperature of the electrode provided with the cooling device decreases more rapidly than the temperature of the other electrode. Thus, the particles of the enclosed material are deposited on the electrode provided with the cooling device.

EXAMPLE 3

Figure 5:
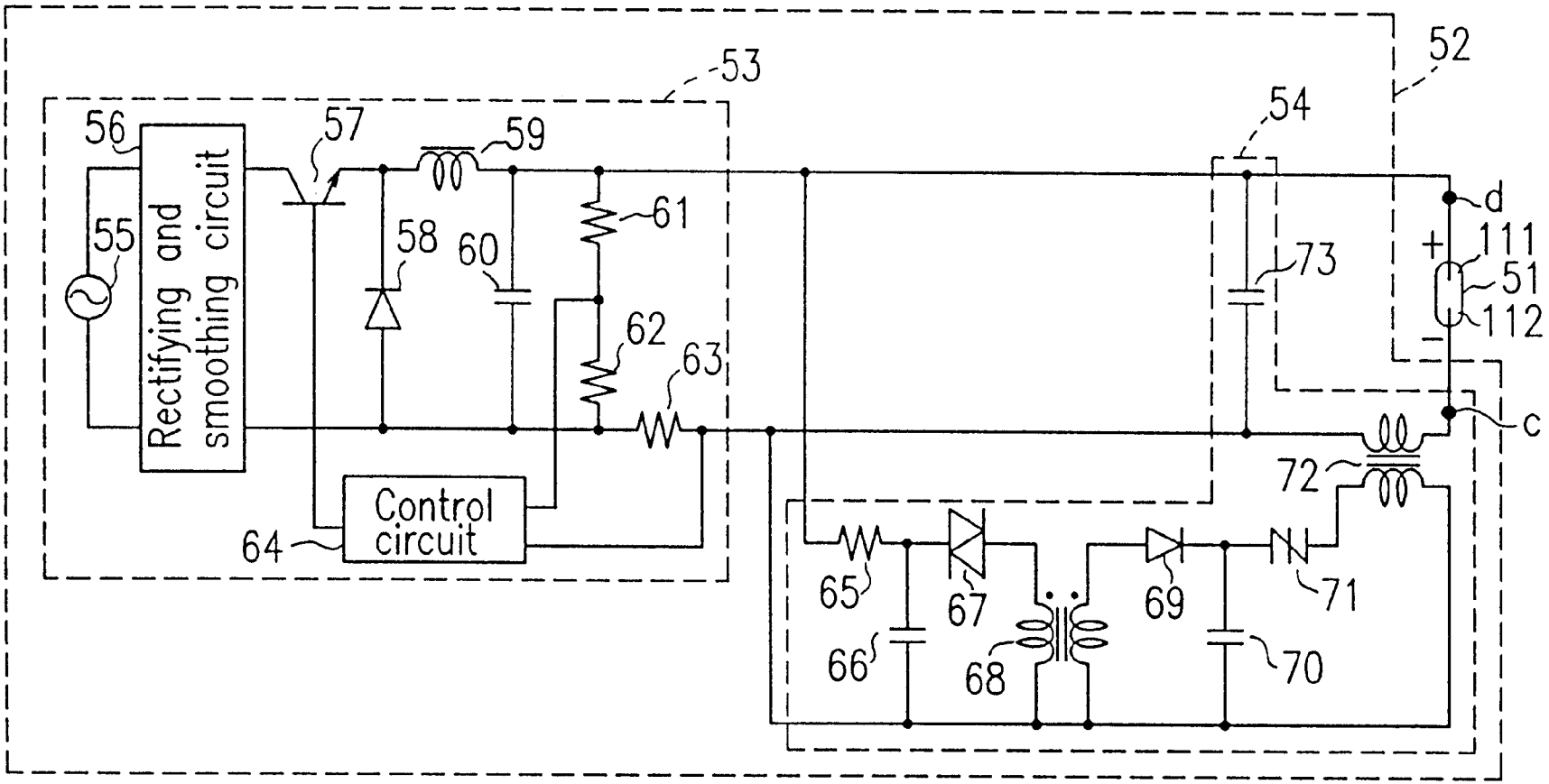
FIG. 5 is a schematic configuration of a ballast circuit in an operating apparatus for a discharge lamp in a third example according to the present invention.

FIG. 5 is a schematic view of the structure of an operating apparatus for a discharge lamp in a third example according to the present invention.

To a discharge lamp 51 (e.g., a 200 W metal halide lamp) having a pair of electrodes 101 and 102, a ballast circuit 52 for starting and maintaining the operating condition of the discharge lamp 51 is connected. The ballast circuit 52 includes a DC power supply 53 and a starting pulse generator 54.

The DC power supply 53 includes a rectifying and smoothing circuit 56 for rectifying and smoothing an output from an AC power supply 55 for commercial use to convert the output into a DC output, and a control section. The control section, which includes a transistor 57, a diode 58, a choke coil 59, a capacitor 60, resistors 61, 62 and 63, and a control circuit 64, receives the output from the rectifying and smoothing circuit 56 and controlling the power to be supplied to the lamp 51 to be at a prescribed value. The resistors 61 and 62 detect the output voltage from the DC power supply 53 (lamp voltage), and the resistor 63 detects the output current from the DC power supply 53 (lamp current). The two detection signals obtained by the resistors 61, 62 and 63 are processed by the control circuit 64, and the transistor 57 is controlled to be turned on or off by an output signal from the control circuit 64 so that the output voltage from the DC power supply 53 (lamp voltage) has a prescribed value.

The starting pulse generator 54 includes a resistor 65, a capacitor 66, a bidirectional two-terminal thyristor 67 which becomes conductive when the voltage of the capacitor 66 reaches a prescribed value, a transformer 68, a diode 69, a capacitor 70, a discharge gap 71 which becomes conductive when the voltage of the capacitor 70 reaches a prescribed value, a pulse transformer 72, and a capacitor 73. Thus, the starting pulse generator 54 generates a starting pulse for starting the lamp 51.

Hereinafter, the operation of the operating apparatus according to the present invention will be described.

When the lamp 51 is operated under the rated conditions, the output voltage from the DC power supply 53 (lamp voltage) detected by the resistors 61 and 62 and the output current from the DC power supply 53 (lamp current) detected by the resistor 63 are processed by the control circuit 64, and the transistor 57 is controlled to be turned on or off by an output signal from the control circuit 64 so that the output voltage from the DC power supply 53 (lamp voltage) has a prescribed value. In this example, the electrode 111 connected on the anode side has a higher temperature than the electrode 112 connected on the cathode side since the lamp 51 is operated by the direct current.

When the lamp 51 is operated under the rated conditions and then turned off, the lamp 51 enters the following state.

When the lamp 51 is turned off, the temperature of the lamp 51 starts decreasing. As in the first and second examples, the temperature of the electrodes 111 and 112 decreases more rapidly than the temperature of the arc tube. Moreover, since the lamp 51 is operated by the direct current, the electrode 111 has a higher temperature than the electrode 112. Accordingly, even when the temperatures of the electrodes 111 and 112 decrease at the same rate, the temperature of the electrode 112 connected on the cathode side is decreased to a sufficiently low temperature more rapidly than the electrode 111. As a result, the particles of the enclosed material are deposited on the electrode 112 and hardly deposited on the electrode 111. In this manner, the state where the particles of the enclosed material are deposited on only one electrode is realized.

In the state where the particles of the enclosed material are deposited on only the electrode 112, a starting pulse is applied to the lamp 51 so as to form an electric field in the direction from the electrode 112 with the particles to the electrode 111 with no particles. Thus, the 200 W metal halide lamp 51 can be operated at a relatively low starting voltage by a simple structure without the temperature retaining film or member (or, a heating device or a cooling device), as described in the first or second example in the state where the $\gamma$ action is generated at the electrode having no particles deposited thereon.

The starting pulse generator 54 is operated in the same manner as in the first and second examples. In more detail, among nodes c and d connected to the lamp 51 in the circuit configuration shown in FIG. 5, the waveform of the voltage at the node c is as shown in FIG. 3. The detailed description of the operation of the starting pulse generator 54 will be omitted herein.

In the third example, the lamp 51 is operated by the direct current in order to intentionally deposit the particles of the enclosed material on one of the electrodes 111 or 112 of the 200 W metal halide lamp 51. By such a system, the electrode 111 connected on the anode side has a higher temperature than the electrode 112 connected on the cathode side. Accordingly, when the lamp 51 is turned off, the temperature of the electrode 112 reaches a low temperature condition at an earlier time than the temperature of the electrode 111, and thus the particles of the enclosed material are mostly deposited on the electrode 112. In the state where the particles of the enclosed material are deposited only on one electrode 112, a starting pulse is applied to the lamp 51 so as to generate an electric field in the direction from the electrode 112 with the particles to the electrode 111 with no particles. In this manner, the γ action is generated at the electrode having no particles deposited thereon, and thus, the 200 W metal halide lamp 51 can be operated at a sufficiently low starting voltage with a simple structure without using the temperature retaining film or member (or, a heating device or a cooling device), as described in the first or second example.

The DC current to be supplied to the lamp 51 in order to maintain the operating state need not be a completely direct current, but is sufficient to include a DC component. Specifically, when the average over time does not become zero, but rather stands at a certain positive/negative value, the advantages as described above can be achieved. For example, a current having a pulse-type sine waveform modulated in the PWM process can be used.

In the first, second and third examples, a 200 W metal halide lamp is used as the discharge lamp. Other types of lamps, for example, a high pressure sodium lamp can be used. The wattage is not limited to 200 W.

It should be noted, however, that the beneficial effect of the present invention is especially conspicuous when a metal halide lamp is used. The reason is that a metal halide enclosed in the metal halide lamp, which has a high electronegativity, causes a significant increase in the starting voltage when deposited on the electrode in the metal halide lamp compared to when deposited on the electrode in other types of HID lamps.

The DC power supply included in a ballast circuit according to the present invention can have any other structure as long as the DC output can be controlled. For example, the DC power supply can be a combination of an AC power supply and a rectifier. The inverter circuit can have any structure as long as the output from the DC power supply (or an equivalent thereof) can be converted into an AC output. The starting pulse generator can have any structure as long as a starting pulse for generating an electric field in the direction from the electrode having the particles of the enclosed material depositing thereon to the electrode with no particles can be applied.

In the first, second and third examples, the pair of electrodes in the lamp can face each other in a horizontal direction or a vertical direction. In the case where the electrodes are provided so as to face each other in the vertical direction (i.e., so that one of the electrodes is above the other electrode), the electrode on which the particles are deposited is preferably positioned lower than the other electrode. By such an arrangement, the temperature in the vicinity of the upper electrode is further prevented from decreasing, due to (1) the effect of the gravity, and (2) the generation of the thermal convection. Thus, the deposition of the particles of the enclosed material on the lower electrode is further promoted.

Alternatively, a member for generating mechanical vibration can be provided in the vicinity of the electrode which is not supposed to have the particles deposited thereon. In such a structure, deposition of the particles on such an electrode is physically prevented by mechanical vibration. Since the deposition of the particles of the enclosed material generally starts about 10 seconds after the lamp is turned off, an appropriate magnitude of vibration is applied to one of the electrodes several seconds after the lamp is turned off. Specifically, the vibration can be applied using an apparatus with a piezoelectric element.

In an operating apparatus (i.e., a lightening apparatus) of a discharge lamp according to the present invention, particles of the material enclosed in the discharge lamp are deposited on only one of two electrodes. The next time when the lamp is operated, a starting pulse is applied so as to generate an electric field in the direction from the electrode with the particles deposited thereon to the electrode with no particles. Thus, the γ action is generated at the electrode having no particles deposited thereto, and the efficiency of the secondary emission by the γ action is increased when discharge starts. Therefore, the level of the starting voltage can be maintained sufficiently low.

A sufficiently low level of the starting voltage reduces the size of the starting pulse generator. In more detail, the components of the starting pulse generator, specifically a pulse transformer, which is one of the largest components of the starting pulse generator, is reduced in size. Accordingly, the size of the starting pulse generator is also reduced. Moreover, because of a reduced level of the starting voltage, sufficient insulation can be more easily achieved with a reduced size of the starting pulse generator.

Since the lower starting voltage alleviates the damage to the electrodes, the life of the discharge lamp is increased.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. An operating apparatus for a discharge lamp, the discharge lamp including a pair of electrodes and an arc tube having a material enclosed therein, the operating apparatus comprises:

a selective depositing device for selectively depositing the material on one electrode of the pair of electrodes when the discharge lamp is turned off; and a ballast circuit for starting operation of the discharge lamp and maintaining the operation under rated conditions, wherein the ballast circuit includes a starting pulse generator for applying a starting pulse to the discharge lamp when the discharge lamp starts the operation, the starting pulse generating an electric field acting from the one electrode of the pair of electrodes having the material deposited thereon to the other electrode.

2. An operating apparatus according to claim 1, wherein the discharge lamp comprises the selective depositing device.

3. An operating apparatus according to claim 2, wherein, when the discharge lamp is turned off, the temperature of the electrode on which the material is to be selectively deposited decreases more rapidly than the temperature of the other electrode.

4. An operating apparatus according to claim 3, wherein the discharge lamp further includes a temperature retaining film provided in the vicinity of one electrode of the pair of electrodes.

5. An operating apparatus according to claim 3, wherein each electrode of the pair of electrodes has a different heat capacity from the other.

6. An operating apparatus according to claim 5, wherein each electrode of the pair of electrodes has a different shape from the other.

7. An operating apparatus according to claim 5, wherein each electrode of the pair of electrodes has a different volume from the other.

8. An operating apparatus according to claim 5, wherein each electrode of the pair of electrodes has a different surface area from the other.

9. An operating apparatus according to claim 5, wherein each electrode of the pair of electrodes is formed of a material having a different specific heat from the other.

10. An operating apparatus according to claim 1, wherein the selective depositing device is provided in the discharge lamp.

11. An operating apparatus according to claim 10, wherein, when the discharge lamp is turned off, the selective depositing device decreases the temperature of the electrode on which the material is selectively deposited more rapidly than the temperature of the other electrode.

12. An operating apparatus according to claim 11, wherein the selective depositing device is a temperature retaining member.

13. An operating apparatus according to claim 11, wherein the selective depositing device is a heating device.

14. An operating apparatus according to claim 11, wherein the selective depositing device is a cooling device.

15. An operating apparatus according to claim 11, wherein the selective depositing device is a heat radiation device.

16. An operating apparatus according to claim 1, wherein the ballast circuit applies a current including at least a DC component to the discharge lamp while the discharge lamp is operating and thus makes the temperature of one electrode of the pair of electrodes higher than the temperature of the other electrode so as to selectively deposit the material on the electrode having the lower temperature when the discharge lamp is turned off.

17. An operating apparatus according to claim 1, wherein the ballast circuit includes a vibration application device for applying mechanical vibration to the electrode on which the material is not to be deposited, during a prescribed period of time in which the discharge lamp is off.

18. An operating apparatus according to claim 1, wherein the pair of electrodes are arranged along a direction in which gravity acts, and the electrode on which the material is to be deposited is positioned lower than the other electrode.

19. An operating apparatus according to claim 1, wherein the enclosed material includes at least a metal halide.

* * * * *